US012268251B1

(12) United States Patent
Lugassi et al.

(10) Patent No.: US 12,268,251 B1
(45) Date of Patent: Apr. 8, 2025

(54) SEAMLESS GARMENT WITH BONINGS

(71) Applicants: Asher Lugassi, Beverly Hills, CA (US); Aleksandra Lugassi, Beverly Hills, CA (US)

(72) Inventors: Asher Lugassi, Beverly Hills, CA (US); Aleksandra Lugassi, Beverly Hills, CA (US)

( * ) Notice: Subject to any disclaimer, the term of this patent is extended or adjusted under 35 U.S.C. 154(b) by 0 days.

(21) Appl. No.: 18/747,361

(22) Filed: Jun. 18, 2024

(51) Int. Cl.
*A41B 9/06* (2006.01)

(52) U.S. Cl.
CPC ..... *A41B 9/06* (2013.01); *A41B 2400/38* (2013.01)

(58) Field of Classification Search
CPC ..... A41B 9/06; A41B 2400/38
USPC ..... 450/113
See application file for complete search history.

(56) References Cited

U.S. PATENT DOCUMENTS

| | | | | | |
|---|---|---|---|---|---|
| 458,262 | A * | 8/1891 | Swartwout | | |
| 1,995,801 | A | 3/1935 | Field | | |
| 2,288,703 | A * | 7/1942 | Herbener | A41C 1/00 | D2/702 |
| 2,406,893 | A * | 9/1946 | Nunn | A41C 3/06 | 450/41 |
| 2,448,919 | A * | 9/1948 | Shulman | A41C 3/06 | 450/41 |
| 2,508,580 | A | 5/1950 | Mixon | | |
| 2,512,215 | A | 6/1950 | Rosenthal | | |
| 2,524,620 | A * | 10/1950 | Cadous | A41C 3/06 | D2/706 |
| 2,524,621 | A * | 10/1950 | Cadous | A41C 3/06 | D2/706 |
| 2,553,036 | A * | 5/1951 | Christensen | A41C 1/06 | 450/86 |
| 2,612,642 | A | 10/1952 | Robins | | |
| 2,697,225 | A * | 12/1954 | Roth | A41C 3/06 | 450/131 |
| 2,704,701 | A | 3/1955 | Wohlman | | |
| 2,852,781 | A * | 9/1958 | Ganser | A41C 1/16 | 450/143 |
| 2,888,931 | A | 6/1959 | Schaumer | | |
| 2,900,984 | A * | 8/1959 | Cunningham | A41C 1/00 | 450/143 |
| 2,925,817 | A | 2/1960 | Rogers | | |
| 3,054,407 | A | 9/1962 | Dernburg | | |
| 3,090,387 | A | 5/1963 | Hopper | | |
| 3,166,076 | A | 1/1965 | Brown | | |
| 3,394,706 | A | 7/1968 | Simon | | |
| 3,704,713 | A | 12/1972 | Hopper | | |
| 4,983,140 | A * | 1/1991 | Gimble | A41C 1/06 | 450/35 |
| 5,537,690 | A * | 7/1996 | Johnson | A61F 5/028 | 2/45 |
| 5,667,422 | A | 9/1997 | Erwin | | |
| 6,234,867 | B1 | 5/2001 | Fanelli | | |
| 6,883,179 | B1 * | 4/2005 | Crum | A41D 1/22 | 2/105 |

(Continued)

*Primary Examiner* — Gloria M Hale
(74) *Attorney, Agent, or Firm* — Mesh IP Law, PC; Michael Eshaghian

(57) ABSTRACT

A seamless garment is provided comprising a body portion, a binding, a plurality of channels, a plurality of bonings, and optionally, a cup portion. The body portion has anterior and posterior fabric portions, which are comprised of a single piece of fabric. Channels are located in between the layers of the body portion, and bonings are contained within the channels.

24 Claims, 10 Drawing Sheets

(56) References Cited

U.S. PATENT DOCUMENTS

| | | | | |
|---|---|---|---|---|
| 7,416,470 | B2 | 8/2008 | Zarabi | |
| 8,695,115 | B2 | 4/2014 | Leyva | |
| 9,011,200 | B2 | 4/2015 | Upton | |
| 9,232,822 | B1 | 1/2016 | Khubani | |
| 9,648,911 | B2 * | 5/2017 | Welsch | A41C 1/003 |
| 9,795,172 | B1 | 10/2017 | Lee | |
| 9,949,513 | B2 | 4/2018 | Angelino | |
| 10,136,680 | B2 * | 11/2018 | Angelino | A41C 1/003 |
| 10,575,567 | B1 | 3/2020 | Krechmaras | |
| 11,375,757 | B1 | 7/2022 | Krechmaras | |
| 12,114,713 | B2 * | 10/2024 | Elements | A41C 1/14 |
| 2002/0022433 | A1 | 2/2002 | Yeung | |
| 2007/0077859 | A1 | 4/2007 | Walker | |
| 2017/0208871 | A1 * | 7/2017 | Angelino | A41C 1/06 |
| 2017/0233906 | A1 | 8/2017 | Hwang | |
| 2017/0290377 | A1 | 10/2017 | Liu | |

* cited by examiner

SEAMLESS GARMENT WITH BONINGS

FIELD OF THE INVENTION

The present invention relates to seamless shaping garments.

BACKGROUND OF THE INVENTION

Seamless garments may be worn underneath clothing, as bras, so that they provide a smooth, "invisible" look, especially underneath sheer or tight clothing, or worn as the outer layer of clothing. Seamless garments are generally knitted or otherwise made out of a single piece of fabric rather than multiple pieces stitched together. More particularly, seamless garments are generally made by seamless circular knitting machines, via methods known by persons of ordinary skill in the art, such that the end product is a tube of fabric.

Seamless garments are usually made of soft fabrics such as nylon, spandex, polyester, cotton, modal, viscose, or other similar materials, including combinations of the foregoing. The seamless nature of the garments, along with the fabric, provides for a comfortable wearing experience that also allows the wearer flexibility and versatility in the types of outfits it can be worn underneath or with. For instance, they may be worn with (or as) loungewear, activewear, tight-fitting clothing, or training bras.

However, the flexibility and comfort of a seamless garment, especially a seamless bra, also generally results in a lack of sufficient support for the breasts. Seamless garments also struggle with providing sufficient support for the wearer's body and torso, and with allowing the wearer to have a more flattering figure.

SUMMARY OF THE INVENTION

The present invention provides for a garment that provides the benefits of a seamless bra or other similar garment while addressing the lack of support and structure common to such garments. A body portion is provided configured to rest on a wearer, the body portion having a top end, a bottom end, an anterior fabric portion, and a posterior fabric portion, wherein each of the anterior fabric portion and the posterior fabric portion has an inner face and an outer face, a single piece of fabric comprises the anterior fabric portion and the posterior fabric portion, the posterior fabric portion and anterior fabric portion are each made from at least one of recycled yarn, antibacterial yarn, cooling yarn, or heating yarn; a binding attached to the top end or to the bottom end; a plurality of channels attached to the inner face of one of the anterior fabric portion or the posterior fabric portion; and a plurality of bonings, wherein at least one boning is fitted into each of the plurality of channels.

In some embodiments the garment further comprises at least one shoulder strap configured to rest on the wearer's shoulders.

In some other embodiments, the body portion further comprises a first end and a second end, and a fastener is provided that releasably attaches the first end and second end.

In other embodiments, the bottom end lies on or below approximately the wearer's waist, while in other embodiments, it may lie above the wearer's waist, such as on the ribs just below the bust.

In yet other embodiments, the body portion of the garment may have a cup portion where the wearer may place her breasts for further support and structure.

In other embodiments, the garment may have also a skirt portion.

In some other embodiments, the garment may also have at least one sleeve attached to the body portion.

These and other features and advantages of the present invention will become more readily apparent during the following detailed description taken in conjunction with the drawings herein.

DETAILED DESCRIPTION OF THE INVENTION

Figure 1A:
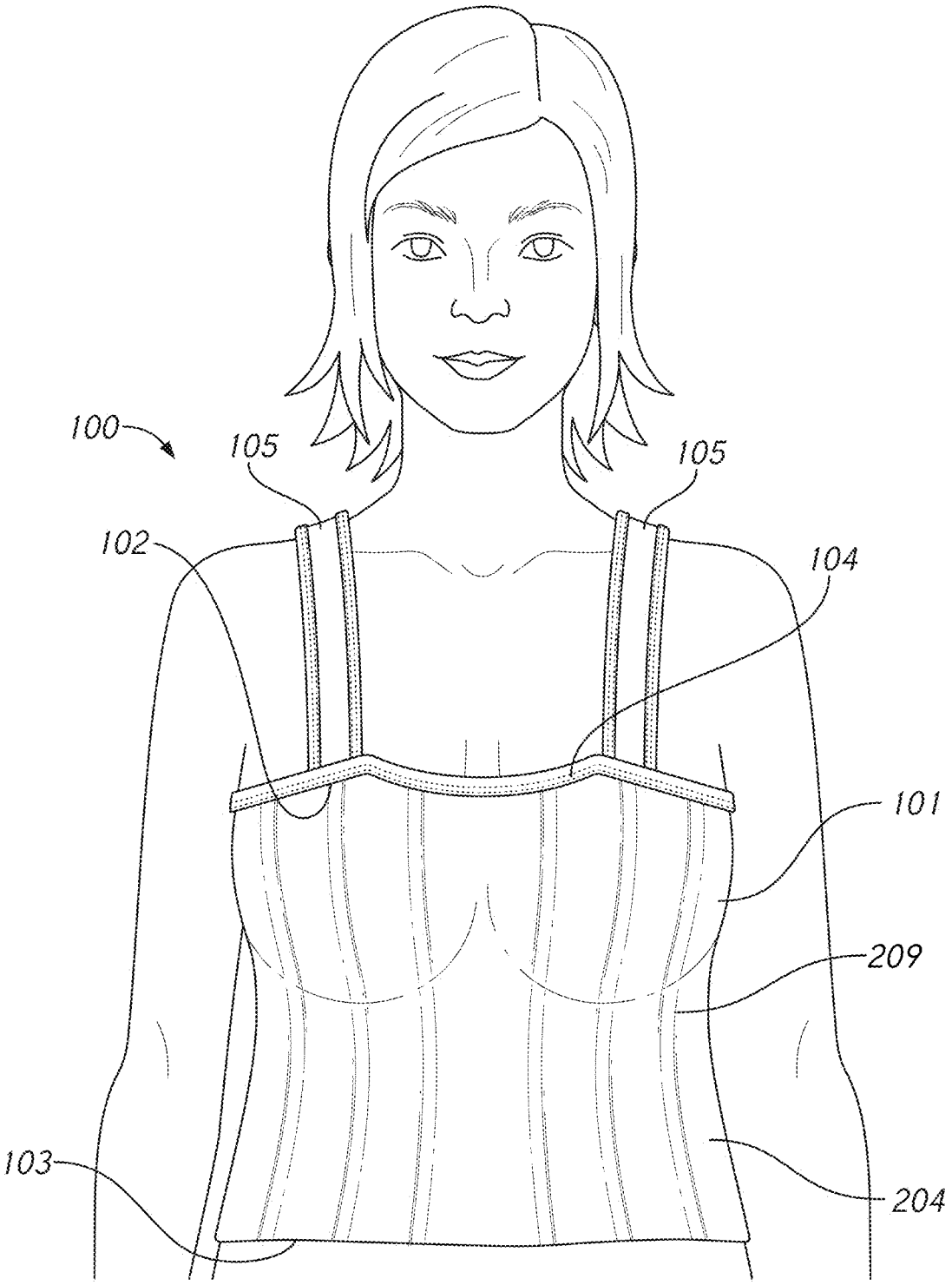
FIG. 1A is a front view of a seamless garment according to one embodiment of the present invention.
Figure 1B:
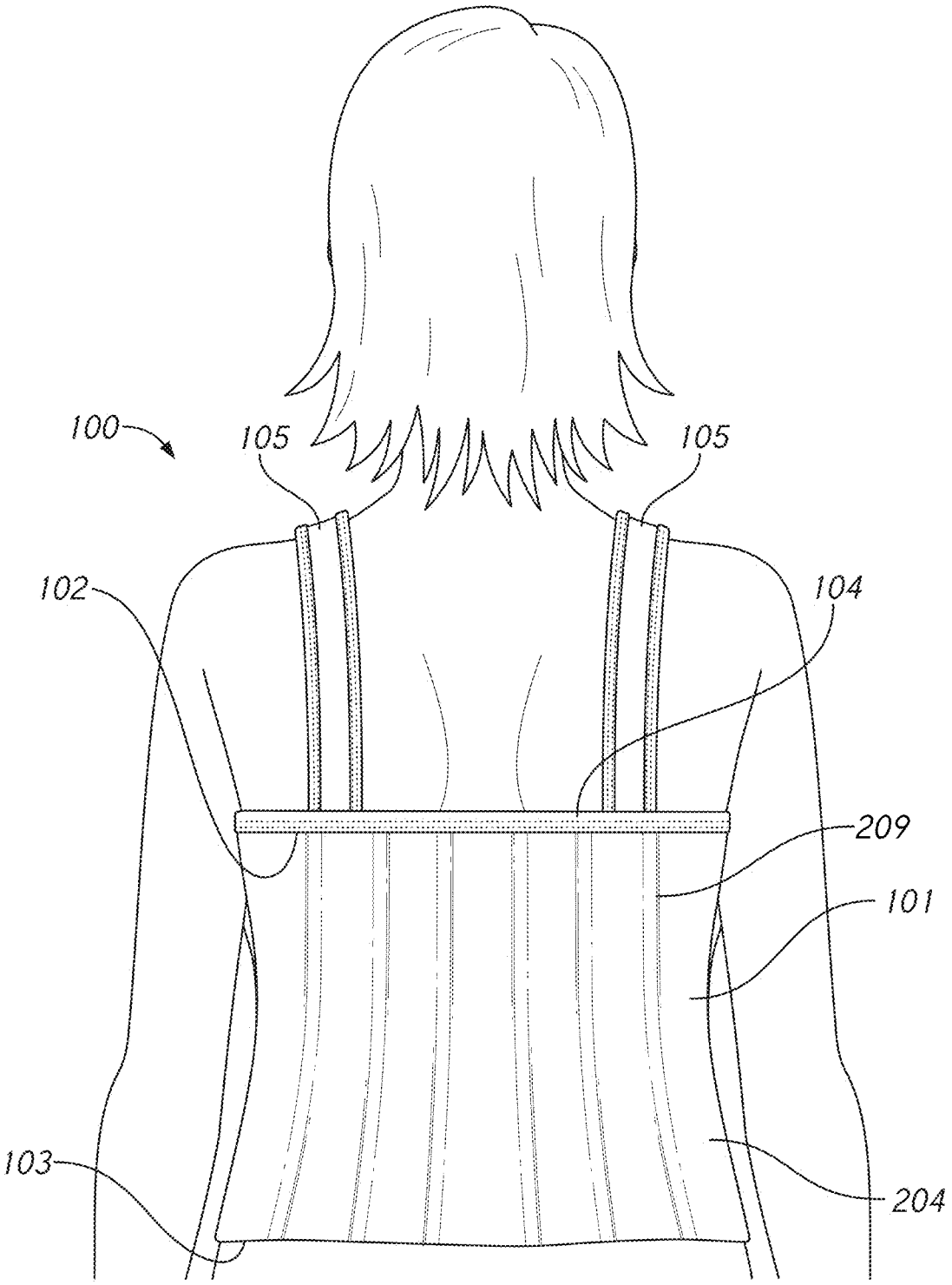
FIG. 1B is a back view of the seamless garment of FIG. 1A.
Figure 2A:
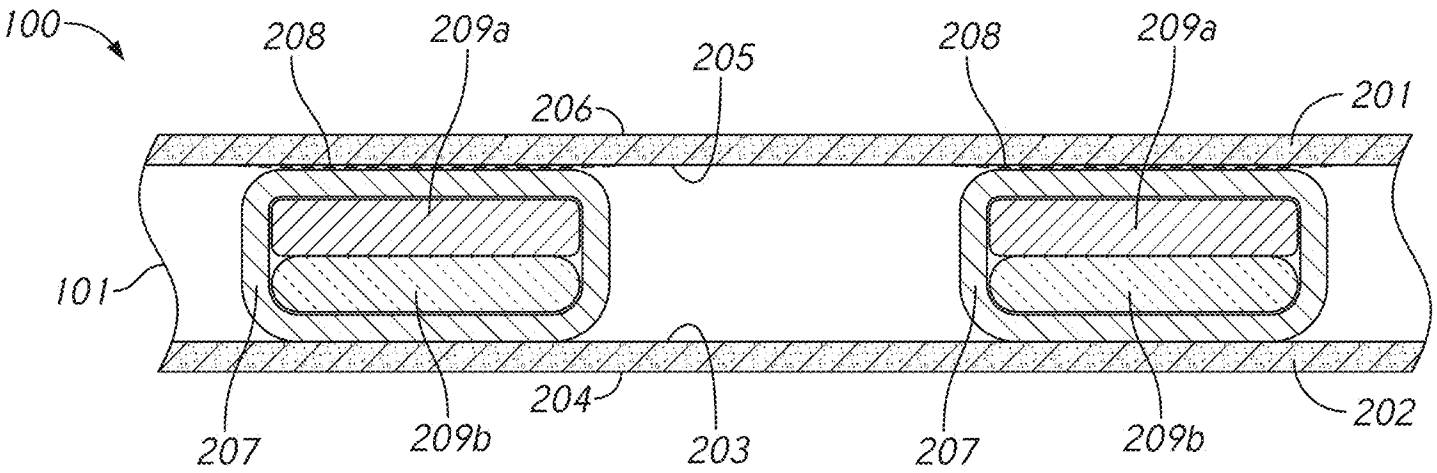
FIG. 2A is a horizontal cross-sectional view of the seamless garment of FIGS. 1A and 1B.
Figure 2B:
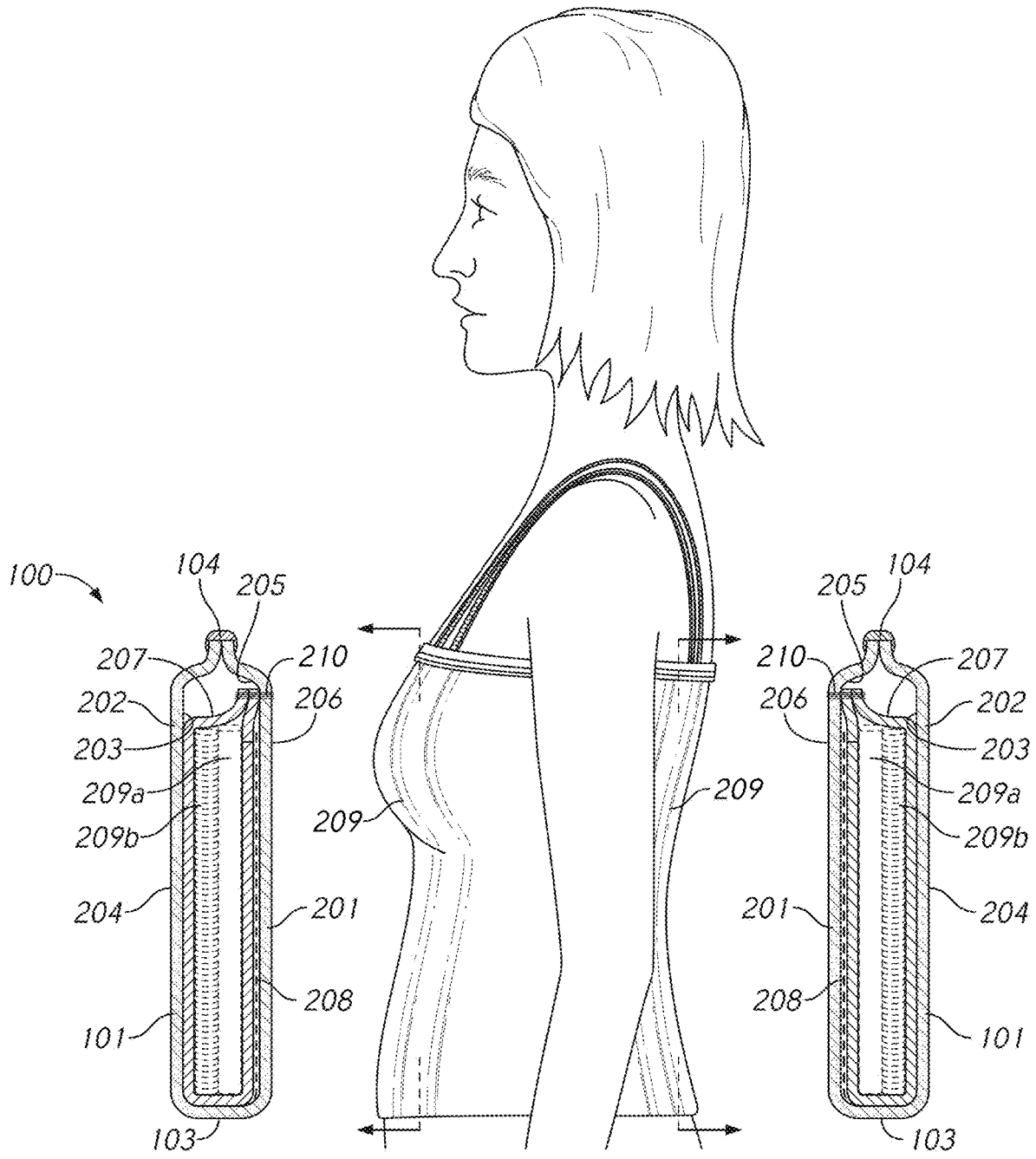
FIG. 2B is a vertical cross-sectional view of the seamless garment of FIGS. 1A and 1B.

FIGS. 1A and 1B show a front and back view, respectively, of garment 100, an embodiment of the present invention, while FIGS. 2A and 2B show a horizontal cross-sectional view and a vertical cross-sectional view, respectively, of garment 100. Garment 100 has a body portion 101 which is configured to rest on the wearer. Body portion 101 extends upwards until top end 102 and extends downwards until bottom end 103. Body portion 101 is seamless such that it is made from a single piece of fabric. As can be seen in FIGS. 1A and 1B, there exists no fastener (such as a clasp) to attach two ends of the bra together on the wearer's body; as such, body portion 101 is also continuous. Body portion 101 may be created using methods known in the art to create a seamless, continuous fabric, such as a seamless circular knitting machine.

Top end 102 may lie between the top of the wearer's areolas and the wearer's chest. In the embodiment shown in FIG. 1, bottom end 103 lies on approximately the wearer's waist; however, in other embodiments of the present invention bottom end 103 may lie lower (such as on or below the wearer's hips) or higher (such as on the ribs just below the bust).

As can be seen in FIGS. 2A and 2B, body portion 101 comprises two layers (i.e., is two-ply). Posterior fabric portion 201 is the layer that touches the body of the wearer and anterior fabric portion 202 is the layer that surrounds posterior fabric portion 201. Each of posterior fabric portion 201 and anterior fabric portion 202 has two faces. Inner face 203 of anterior fabric portion 202 and inner face 205 of posterior fabric portion 201 face each other and are not visible to the wearer (or any observer). Outer face 204 of anterior fabric portion 202 faces away from the wearer such that it is the face that is visible to observers. Outer face 206 of posterior fabric portion 201 faces inwards towards the wearer and is the face that touches the wearer's body.

Although body portion 101 is two layers, it is knitted or otherwise made of a single piece of fabric such that body portion 101 is seamless. In one embodiment, the single piece of fabric from which body portion 101 is made is "folded over" at bottom end 103 such that the ends of the fabric are at top end 102. In such a case, a binding 104 may be sewn along top end 102 to join the ends of the fabric comprising body portion 101. In another embodiment, the single piece of fabric from which body portion 101 is made is "folded over" at top end 102 such that the ends of the fabric are at bottom end 103. Binding 104 may be made of fabrics such as nylon, cotton, polyester, viscose, modal, and other like fabrics. Ideally, binding 104 is a material that is elastic.

Body portion 101 contains in between its two layers a plurality of channels 207. Channels 207 may be made from nylon, cotton, polyester, viscose, modal or other such fabrics and are generally vertically situated; that is, their longitudinal axis (i.e., axis parallel to their longest dimension) is generally parallel to the wearer's longitudinal axis but may typically deviate up to around 20 degrees from the wearer's longitudinal axis, but deviations of up to around 45 degrees are contemplated as well. Channels 207 may be attached to either inner face 205 of posterior fabric portion 201 or inner face 203 of anterior fabric portion 202. Stitch 208 illustrates one such potential method of attachment, but other methods known in the art such as gluing may also be used. The opening at the top of channel 207 is stitched to the same fabric face that channel 207 is attached to; in the embodiment shown in FIG. 2B, the opening of channel 207 is stitched with stitch 210 to the inner face 205 of posterior fabric portion 201. Notably, neither stitch 208 nor 210 as shown in FIGS. 2A and 2B are visible on outer face 206 of posterior fabric portion 201.

A plurality of bonings 209 are contained within channels 207. Bonings 209 are long, thin, rods usually made of materials such as steel, polyester, or other plastic. Although bonings 209 are stiff, the large ratio of their longest dimension to their shortest dimension results in a somewhat flexible rod. Bonings 209 act to support the wearer's breast and body. Bonings 209 also act to provide shaping to the wearer's body such that the wearer's body is a more flattering shape. Locating bonings 209 within channels 207 act to ensure bonings 209 do not shift within body portion 101 during wear and to prevent bonings 209 from being in closer contact with the wearer's body, which potentially causes discomfort. Although the outlines of bonings 209 can be seen in FIGS. 1A and 1B, there is no visible seam, such as from stitch 208, on body portion 101.

Multiple bonings 209*a* and 209*b* may be contained in a single channel 207. In such an embodiment, the longest dimensions of bonings 209*a* and 209*b* are adjacent to each other, and boning 209*a* lies closer to the posterior fabric portion 201 (and thus wearer's body) while boning 209*b* lies closer to the anterior fabric portion 202. Boning 209*a*, because it is felt somewhat by the wearer, is typically made of a plastic material shaped in a rectangular fashion and is positioned so that the longer dimension of the rectangular cross-section rests on the wearer's body so that it more comfortable for the wearer. Boning 209*b* is typically made of a metal such as steel.

Having a single boning 209 may be disadvantageous because, if it is made of plastic, it will, over time, slowly lose its shape due to the repeated strains of the wearer sitting and standing, causing wrinkles in garment 100. If it is made of metal, boning 209 will better retain its shape but will generally be uncomfortable for the wearer. Having multiple bonings 209*a* and 209*b* being made of plastic and metal, respectively, retains the advantages of each plastic and metal while addressing their disadvantages. In particular, plastic boning 209*a*, which is closer to the wearer's body, is more comfortable for the wearer while metal boning 209*b* helps plastic boning 209*a* retain its shape and avoid wrinkles in garment 100. Additionally, having multiple bonings 209*a* and 209*b* creates for a stronger garment 100 that is better able to withstand strains and stresses.

A single garment 100 may have multiple bonings 209*a* and 209*b* in one or some channels 207, and a single boning 209 in the remaining channels. Other embodiments of the present invention include a garment 100 having solely single bonings 209 in every channel 207, or solely multiple bonings 209*a* and 209*b* in every channel 207. Additionally, the present invention includes multiple bonings 209*a* and 209*b* being both made of plastic, both made of metal, or one being made of metal and the other of plastic. A reference to "bonings 209" in this disclosure includes a single boning or multiple bonings.

Figure 5:
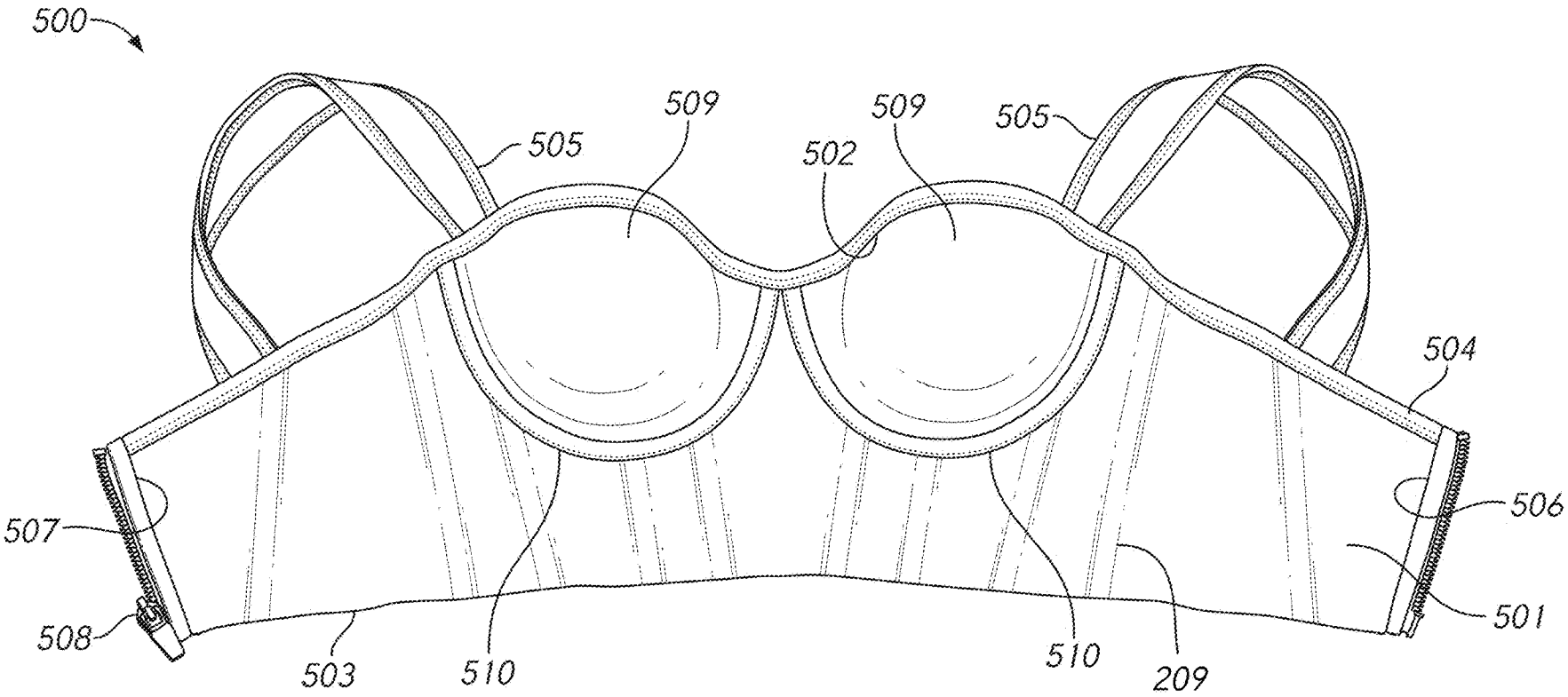
FIG. 5 is a front view of a seamless garment with cups according to another embodiment of the present invention.

Channels 207 and bonings 209 run the length of body portion 101 and may range from about 2 inches to about 18 inches. For example, the longest bonings 209 in the embodiment shown in FIG. 1 are about 12 inches, while the shortest bonings 209 in the embodiment shown in FIG. 5 are about 2 inches.

Optionally, a binding 104 may be located along bottom end 105. Having binding 104 at bottom end 105 reduces the likelihood of bonings 209 poking the wearer or poking through bottom end 103 and causing an uncomfortable and/or unsightly wearing experience.

Optionally, garment 100 may have at least one shoulder strap 105 located along body portion 101's top end 104. Shoulder strap 105 drapes snugly around the wearer's shoulder and provides a more secure fit of garment 100 on the wearer's body by, for example, preventing garment 100 from sliding down the wearer's body or rotating about the wearer's longitudinal axis. Although garment 100 is shown with two shoulder straps 105, it will be appreciated that other embodiments of the present invention may have zero or one shoulder strap.

Figure 3:
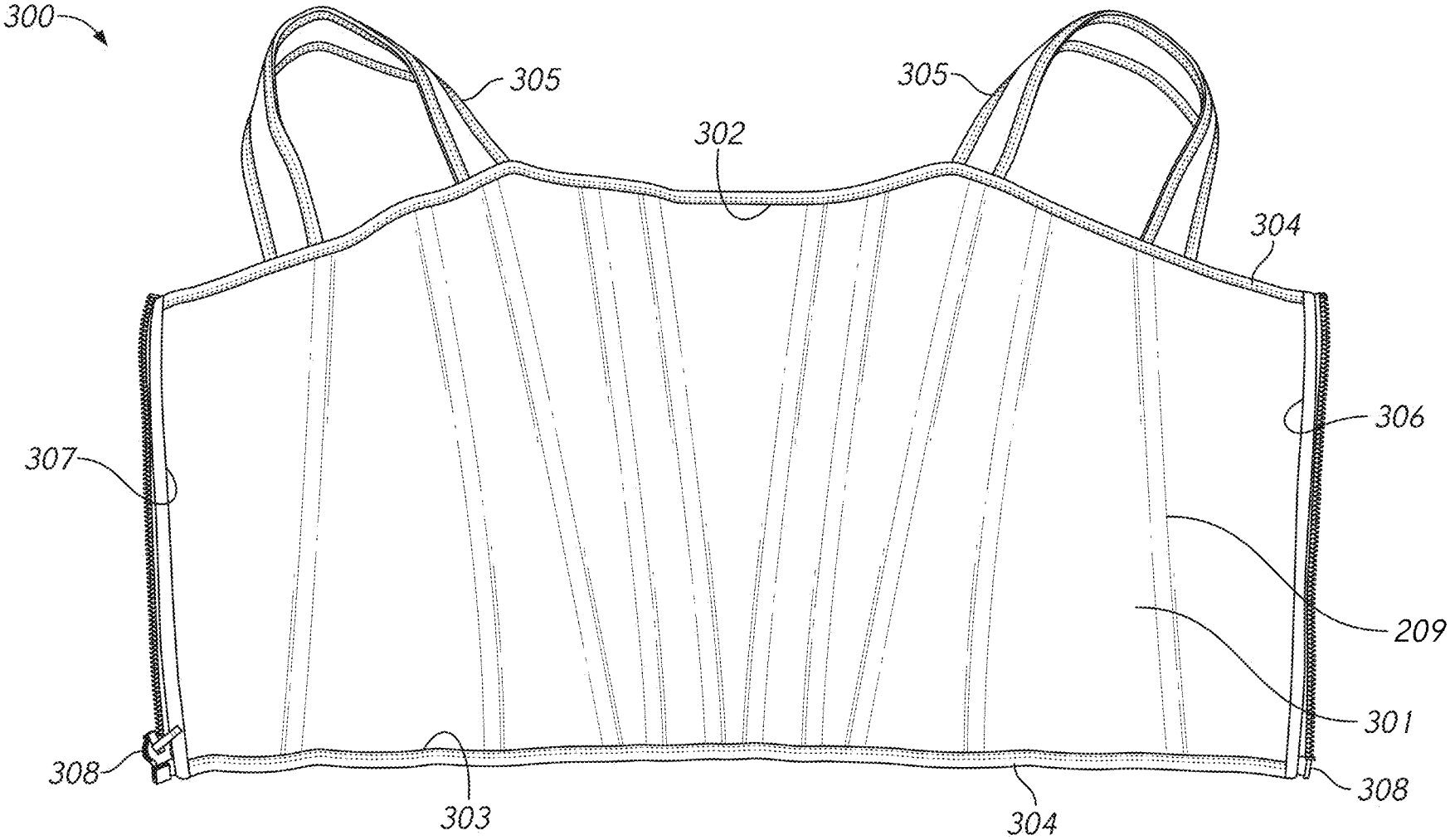
FIG. 3 is a front view of a seamless garment according to another embodiment of the present invention.

Referring to FIG. 3, another embodiment of the present invention is shown as garment 300. Like garment 100, garment 300 has body portion 301 having a top end 302 and bottom end 303; binding 304 along top end 302 (and/or along bottom end 303); and, optionally, shoulder straps 305.

While FIGS. 2A and 2B were discussed with reference to garment 100 of FIGS. 1A and 1B, the elements of FIGS. 2A and 2B also apply to garment 300. That is, like garment 100, body portion 301 of garment 300 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 300 contain a plurality of bonings 209.

Further, like garment 100, body portion 301 is made of a single piece of fabric such that body portion 301 is seamless and such that it has binding 304 along the top end 302 and/or the bottom end 303. However, unlike garment 100, garment 300 is not continuous and instead extends rightward (from the point of view of someone viewing FIG. 3) until terminating at first end 306 and extends leftward until terminating at second end 307.

First end 306 and second end 307 contain fastener 308 that releasably fastens first end 306 and second end 307 together. Fastener 308 may be any fastener known in the art for garments, such as zippers, buttons, clasps, hooks-and-loops, or other similar fasteners.

Figure 4:
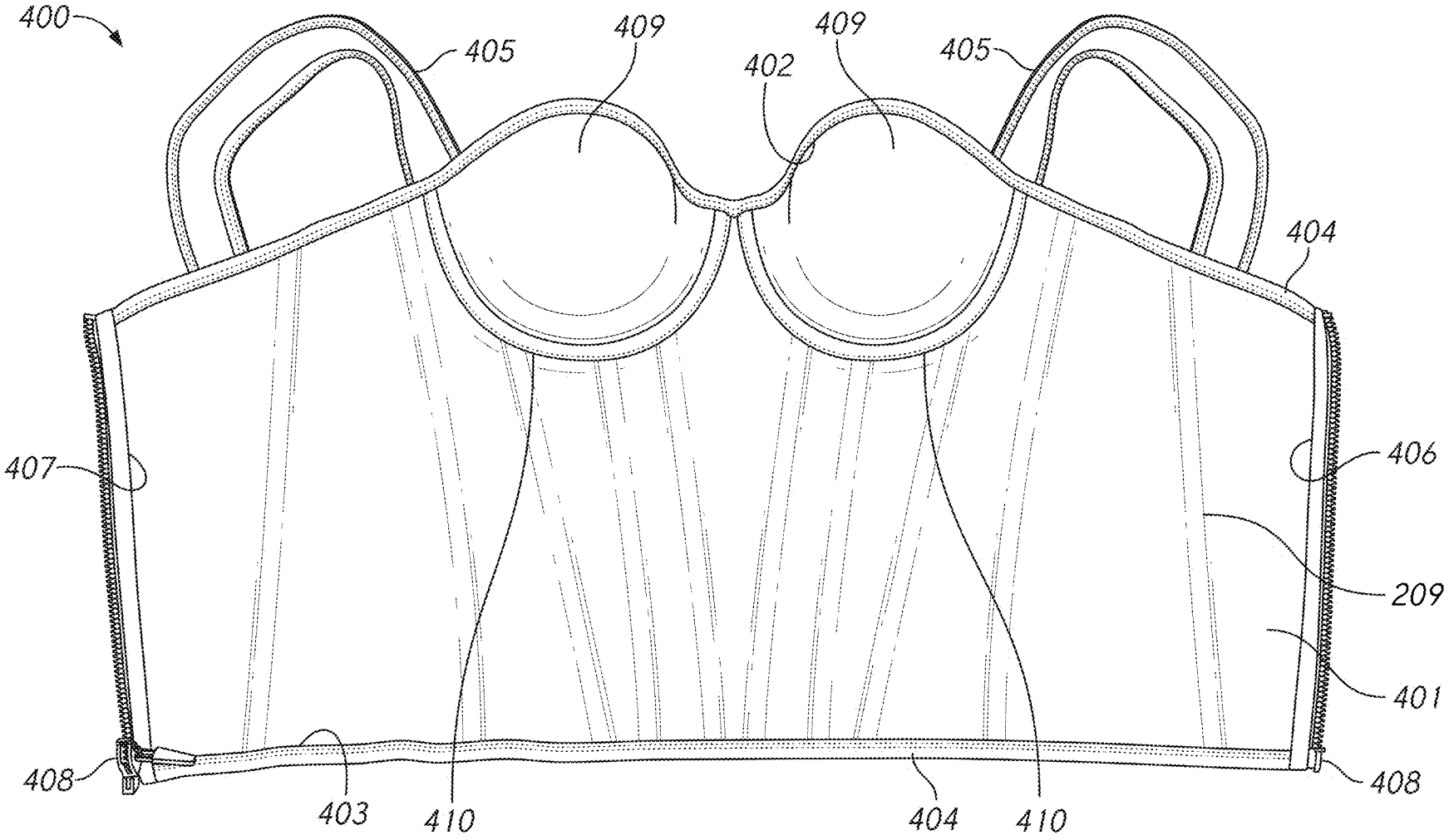
FIG. 4 is a front view of a seamless garment with cups according to one embodiment of the present invention.

Referring to FIG. 4, another embodiment of the present invention is shown as garment 400. Like garment 300, garment 400 has body portion 401 having top end 402, bottom end 403, first end 406, and second end 407; binding 404 along top end 402 (and/or along bottom end 403); fastener 408; and, optionally, shoulder straps 405. It will be appreciated that in other embodiments, garment 400 may be similar to garment 100 in that garment 400 lacks first end 406, second end 407, and fastener 408. In such an embodiment, the wearer wears garment 400 by pulling it on over the head or by stepping into garment 400 and pulling it upwards.

While FIGS. 2A and 2B were discussed with reference to garment 100 of FIGS. 1A and 1B, the elements of FIGS. 2A and 2B also apply to garment 400. That is, like garment 100, body portion 401 of garment 400 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 400 contain a plurality of bonings 209.

Garment 400 additionally has cup portion 409. While wearing garment 400, the wearer's breasts are held in cup portion 409. Cup portion 409 further supports the wearer's breasts and may come in different sizes to reflect various potential breast sizes. In some embodiments, cup portion 409 may be padded to provide extra support by lifting the breasts and holding them in position, which may reduce strain on the wearer's back and shoulders. Such padding, if included, is placed on top of outer face 206 of posterior fabric portion 201 and stitched or otherwise attached to body portion 401. Other benefits to having padding in cup portion 409 include enhancing the shape of the breasts, providing for a more flattering figure, increasing the apparent breast size, concealing the nipples, providing added warmth and comfort, and enhancing cleavage.

Cup portion 409 may optionally have running along its bottom edge an underwire 410. Underwire 410 is contained within a channel similar to channels 207. The channel containing underwire 410 may be attached, via stitching or other similar methods, to outer face 206 of posterior fabric portion 201. Underwire 410 further supports the breasts by lifting and holding the breasts in place and distributing their weight more evenly across the wearer's chest, acting to reduce strain on the back and shoulders. Underwire 410 may also help shape the breasts by providing a more pronounced separation between them and creating a more flattering figure. Underwire 410 also assists in maintaining garment 400's shape over time and provides further comfort for the wearer by reducing the movement of the breasts.

Referring to FIG. 5, another embodiment of the present invention is shown as garment 500. Like garment 400, garment 500 has body portion 501 having top end 502, bottom end 503, first end 506, and second end 507; binding 504 along top end 502 (and/or along bottom end 503); fastener 508; cup portion 509; and, optionally, shoulder straps 505 and underwire 510. It will be appreciated that in other embodiments, garment 500 is similar to garment 100 in that garment 500 lacks first end 506, second end 507, and fastener 508. In such an embodiment, the wearer wears garment 500 by pulling it on over the head or by stepping into garment 500 and pulling it upwards.

While FIGS. 2A and 2B were discussed with reference to garment 100 of FIGS. 1A and 1B, the elements of FIGS. 2A and 2B also apply to garment 500. That is, like garment 100, body portion 501 of garment 500 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 500 contain a plurality of bonings 209.

Whereas the bottom ends 103, 303, and 403 of garments 100, 300, and 400, respectively, are on approximately the wearer's waist or below, the bottom end 503 of garment 500 is on approximately the wearer's ribs just below the bust. Thus, garment 500 is shorter (along the dimension parallel to the wearer's longitudinal axis) than garments 100, 300, and 400. The shorter length of garment 500 allows for a lighter garment and allows for wearer preference not to have the garment resting on the wearer's stomach. Additionally, wearers that are shorter in stature may prefer to wear garment 500. Garment 500 may also allow for greater flexibility and freedom of movement than garments 100, 300, and 400 do, and some wearers may prefer the aesthetics of garment 500 and find it more comfortable.

Figure 6B:
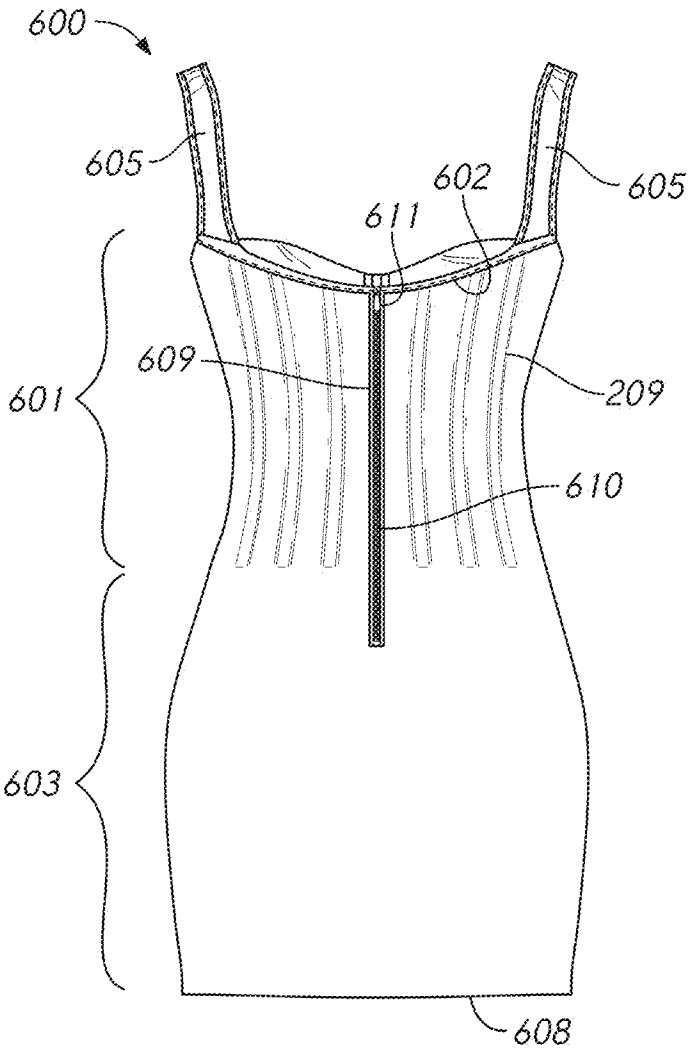
FIG. 6B is a back view of the seamless garment of FIG. 6A.
Figure 6A:
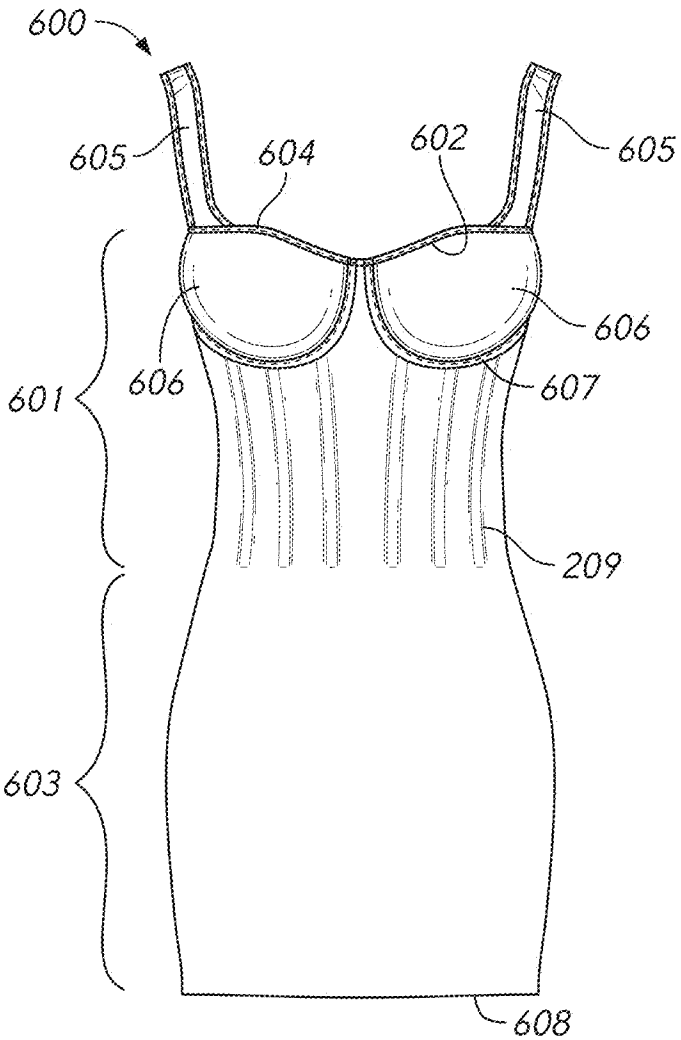
FIG. 6A is a front view of a seamless garment with cups and a skirt portion according to another embodiment of the present invention.

Referring to FIGS. 6A and 6B, another embodiment of the present invention is shown as garment 600. Like garment 400, garment 600 has body portion 601 having top end 602, first end 609, and second end 610; binding 604 along top end 602; fastener 611; cup portion 606; and, optionally, shoulder straps 605 and underwire 607. It will be appreciated that in other embodiments, garment 600 is similar to garment 100 in that garment 600 lacks first end 609, second end 610, and fastener 611. In such an embodiment, the wearer wears garment 400 by pulling it on over the head or by stepping into garment 600 and pulling it upwards.

While FIGS. 2A and 2B were discussed with reference to garment 100 of FIGS. 1A and 1B, the elements of FIGS. 2A and 2B also apply to garment 600. That is, like garment 100, body portion 601 of garment 600 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 600 contain a plurality of bonings 209.

Garment 600 has skirt portion 603 ending in hem 608. Skirt portion 603 is an extension of body portion 601 such that body portion 601 and skirt portion 603 are a single piece of fabric. Thus, posterior fabric portion 201 and anterior fabric portion 202, extend downwards and apply to skirt portion 603, meaning that garment 600 has a posterior fabric portion 201 and anterior fabric portion 202 that run continuously from body portion 601 to skirt portion 603. However, channels 207 and bonings 209 of garment 600 extend only within body portion 601; they do not extend into skirt portion 603.

Figure 7B:
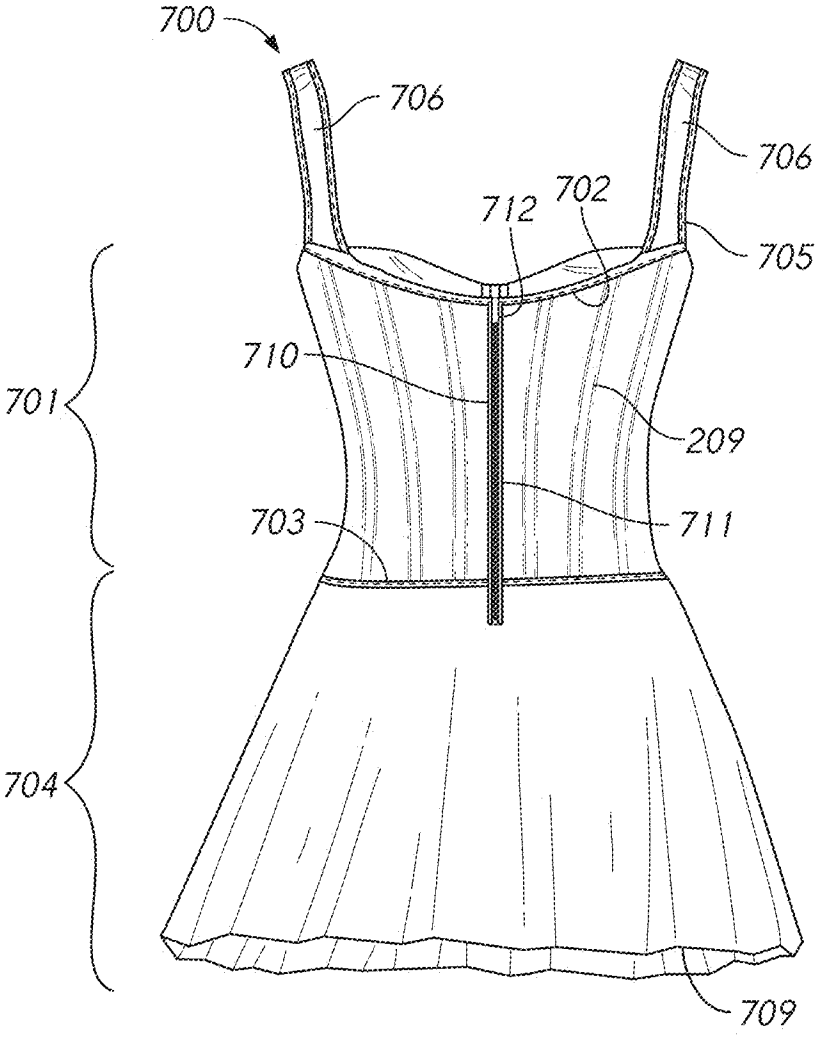
FIG. 7B is a back view of the seamless garment of FIG. 7A.
Figure 7A:
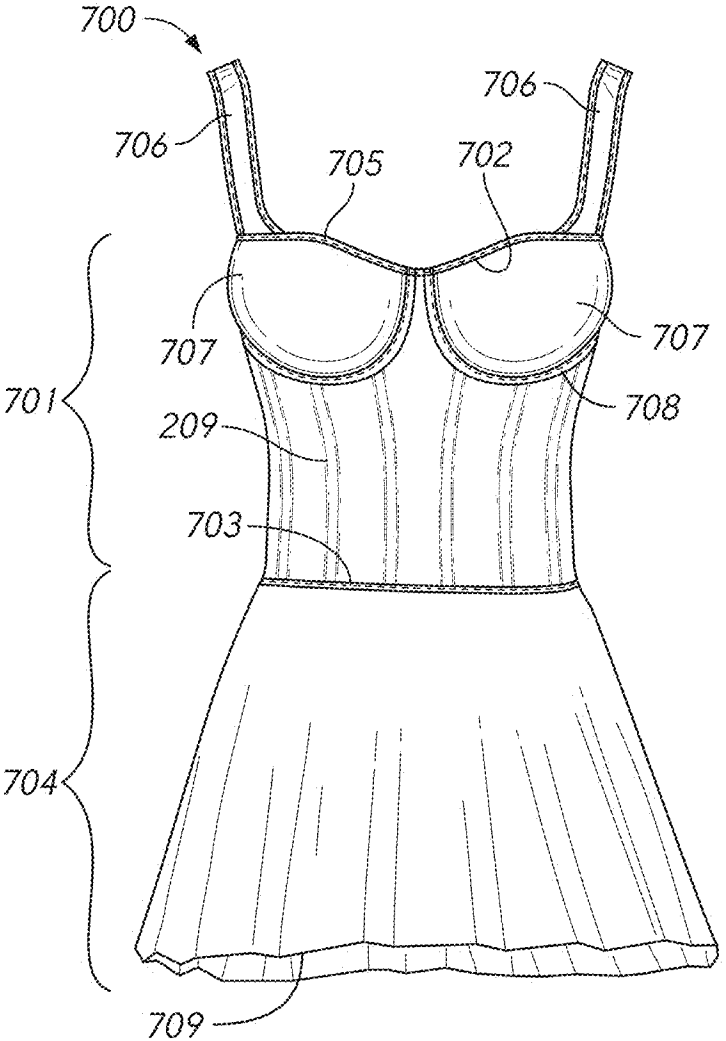
FIG. 7A is a front view of a seamless garment with cups and a skirt portion according to another embodiment of the present invention.

Referring to FIGS. 7A and 7B, another embodiment of the present invention is shown as garment 700. Like garment 600, garment 700 has body portion 701 having top end 702, first end 710, and second end 711; binding 705 along top end 702; fastener 712; cup portion 707; and, optionally, shoulder straps 706 and underwire 708. In addition, body portion 701 has bottom end 703. It will be appreciated that in other embodiments, garment 700 is similar to garment 100 in that garment 700 lacks first end 710, second end 711, and fastener 712. In such an embodiment, the wearer wears garment 700 by pulling it on over the head or by stepping into garment 700 and pulling it upwards.

While FIGS. 2A and 2B were discussed with reference to garment 100 of FIGS. 1A and 1B, the elements of FIGS. 2A and 2B also apply to garment 700. That is, like garment 100, body portion 701 of garment 700 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 700 contain a plurality of bonings 209.

Additionally, like garment 600, garment 700 has a skirt portion 704 ending in hem 709. Unlike garment 600, however, body portion 701 and skirt portion 704 are not a single piece of fabric. Rather, skirt portion 704 is comprised of a separate piece of fabric that is stitched to body portion 701 at bottom end 703, which lies approximately on or between the hips and waist of the wearer. Like garment 600, channels 207 and bonings 209 of garment 700 extend only within body portion 701; they do not extend into skirt portion 704.

Figure 8B:
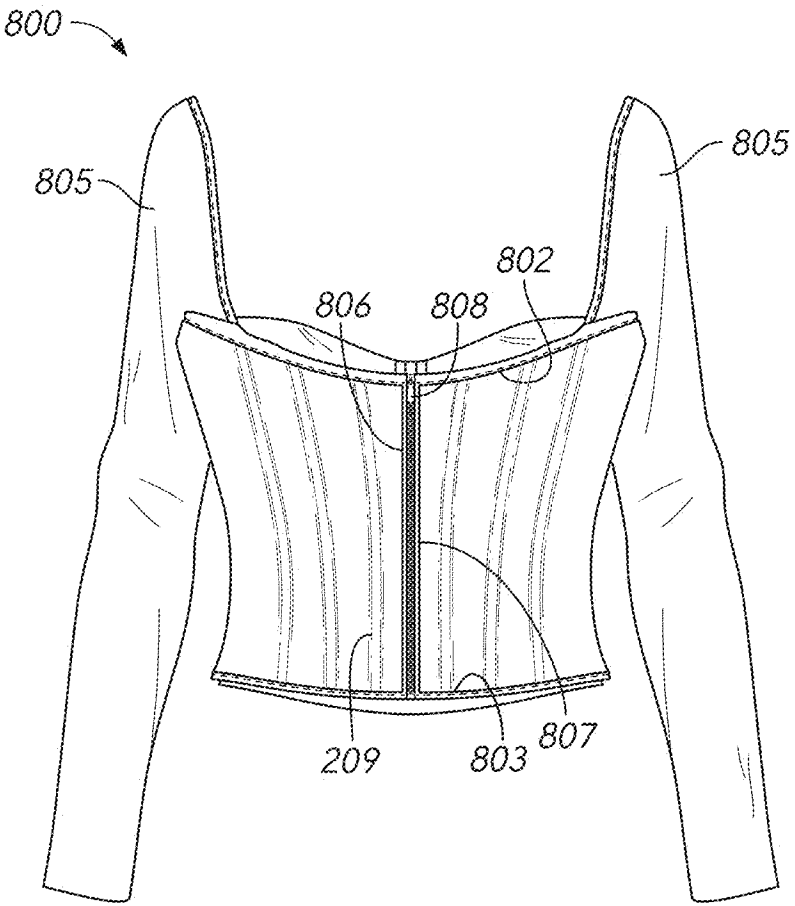
FIG. 8B is a back view of the seamless garment of FIG. 8A.
Figure 8A:
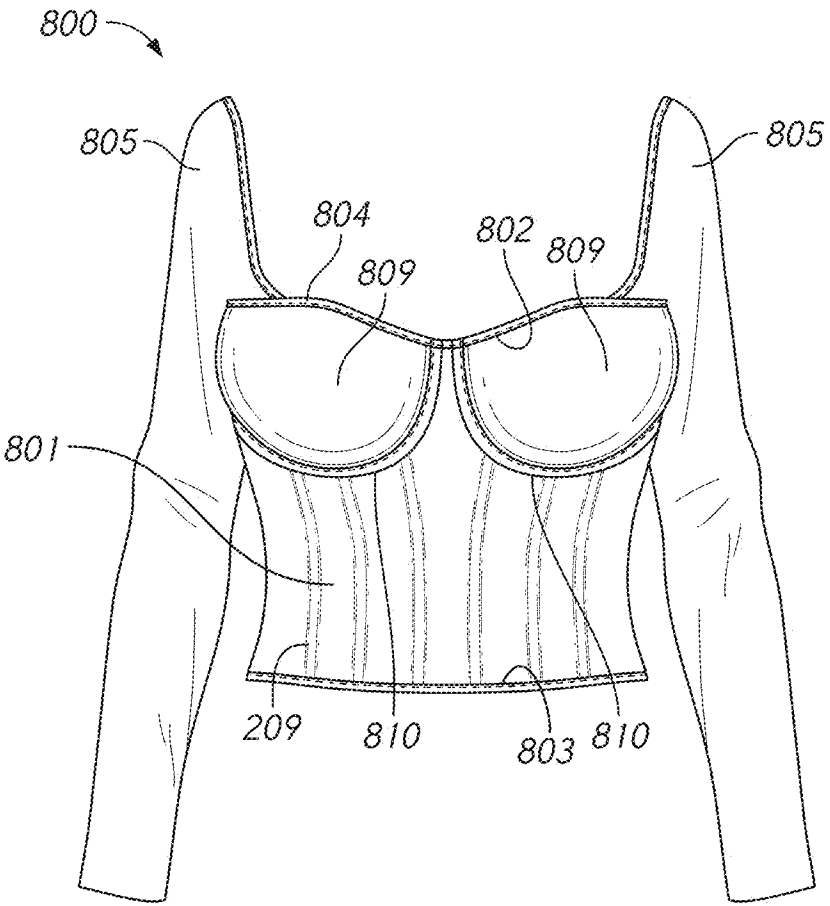
FIG. 8A is a front view of a seamless garment with cups and sleeves according to another embodiment of the present invention.

Referring to FIGS. 8A and 8B, another embodiment of the present invention is shown as garment 800. Like garment 400, garment 800 has body portion 801 having top end 802, bottom end 803, first end 806, and second end 807; binding 804 along top end 802 (and/or along bottom end 803); fastener 808; cup portion 809; and, optionally, shoulder straps 805 and underwire 810. It will be appreciated that in other embodiments, garment 800 is similar to garment 100 in that garment 800 lacks first end 806, second end 807, and fastener 808. In such an embodiment, the wearer wears garment 800 by pulling it on over the head or by stepping into garment 800 and pulling it upwards.

While FIGS. 2A and 2B were discussed with reference to garment 100 of FIGS. 1A and 1B, the elements of FIGS. 2A and 2B also apply to garment 800. That is, like garment 100, body portion 801 of garment 800 comprises two layers, namely posterior fabric portion 201 and anterior fabric portion 202, each of which have inner face 205 and 203, respectively, and outer face 206 and 204, respectively, and has in between its layers a plurality of channels 207 attached to either inner face 205 of posterior fabric portion 201 or inner face 203 of anterior fabric portion 202 with stitches 208 and 210 or other method of attachment. As with garment 100, channels 207 of garment 800 contain a plurality of bonings 209.

Garment 800 has sleeves 805 sewn or otherwise attached to the top end 802. Sleeves 805 may be created via the same method as garment 800 such as by seamless circular knitting machines, via methods known by persons of ordinary skill in the art, such that the end product is a tube of fabric. Although the sleeves 805 depicted are long and reach the wearer's wrists, it will be appreciated the length of the sleeves 805 can vary to be any length from a cap sleeve to a long sleeve.

Additionally, although two sleeves 805 are depicted, it will be appreciated that other embodiments of the present invention may have just one sleeve on the left or right arm, while the other arm remains sleeveless or has a shoulder strap as depicted in previous embodiments.

In all of the foregoing embodiments, and in all embodiments not specifically discussed herein, the fabrics from which the garment is made, including the padding that is optionally provided in the cup portion, may be knitted or otherwise made with various types of specialty yarns, or combinations of various types of specialty yarns. Examples of such specialty yarns include recycled yarns and those with antibacterial properties, cooling properties, or heating properties.

Recycled yarn is desirable due to its positive environmental impact and potential for saving costs during the manufacturing process. For instance, using recycled yarn can reduce carbon dioxide emissions and save water and energy during the manufacturing process. Further, customers may prefer wearing recycled yarn due to the positive environmental impact.

Yarn or fabric with antibacterial properties (or "antibacterial yarn") contains embedded in it additives known in the art, such as silver particles, that reduce viral activity, prevent the growth of bacteria, and have odor-fighting properties. Such additives may be embedded within the fibers during the manufacturing process and generally do not decrease significantly when the garment is washed, and they do not affect the softness of the fabric such that the wearer's comfort is not negatively affected.

Yarn or fabric with cooling properties (or "cooling yarn") is ideal for maintaining a cooler body temperature in warmer weather or during or after physical activity. These fabrics work via methods known in the art, such as moisture wicking, heat dissipation via materials with high thermal conductivity, air permeability, cooling agents, reflective properties, or phase change materials.

Yarn or fabric with heating properties (or "heating yarn") is ideal for maintaining a warmer body temperature in cooler weather. These fabrics can contain additives known in the art such as coffee charcoal and oxide, which work not only to insulate the wearer, but also to reduce odors. Such yarns of fabrics may also function by having high insulation, heat reflective properties, low thermal conductivity, or phase change materials.

The different portions of the present invention may be made with combinations of the foregoing specialty yarns. For example, in a single garment of the present invention, posterior fabric portion may be made with a combination of yarns containing antibacterial and heating properties, while anterior fabric portion may be made with recycled yarn. As another example, cup portion may be made with a combination of recycled yarn and yarn containing heating properties, posterior fabric portion may be made with a combination of yarns containing heating and antibacterial properties, and anterior fabric portion may be made with a combination of recycled yarn and yarn containing heating properties.

Persons of ordinary skill in the art will also appreciate that garments 100, 300, 800, and the like can also be constructed such that the bottom ends 103 and 303, respectively, are located on approximately the wearer's ribs.

Persons of ordinary skill in the art will further appreciate that the present invention may encompass brassieres or other similar garments such as corsets, camisoles, or swimwear, and that some of the embodiments discussed herein, such as garments 600, 700, and 800, may be worn as outerwear.

Further, as used herein and in the claims, the singular forms "a," "an," and "the" include plural referents unless the content clearly dictates otherwise. It should also be noted that the term "or" is generally employed in its sense including "and/or" unless the content clearly dictates otherwise. Unless the context requires otherwise, throughout the specification and claims which follow, the word "comprise" and variations thereof, such as, "comprises" and "comprising" are to be construed in an open, inclusive sense, that is, as "including, but not limited to."

While the present invention has been set forth in terms of a specific embodiment or embodiments, it will be understood that the invention disclosed herein may be modified or altered by those skilled in the art to other configurations. Accordingly, the invention is to be broadly construed and limited only by the scope and spirit of the claims appended hereto.

We claim:

1. A garment to be worn by a wearer, comprising:
- a body portion, the body portion having a top end, a bottom end, an anterior fabric portion, and a posterior fabric portion, wherein
  - each of the anterior fabric portion and the posterior fabric portion has an inner face and an outer face, and
  - a single piece of fabric comprises the anterior fabric portion and the posterior fabric portion;
- a binding attached to at least one of the top end or the bottom end of the body portion;
- a plurality of tubular channels attached to the inner face of one of the anterior fabric portion or the posterior fabric portion; and
- a plurality of bonings, wherein at least one boning is fitted into each of the plurality of channels.

2. The garment of claim 1, further comprising at least one shoulder strap.

3. The garment of claim 2, the body portion further comprising a first end and a second end, wherein a fastener releasably attaches said first end and said second end.

4. The garment of claim 1, the body portion further comprising a first end and a second end, wherein a fastener releasably attaches said first end and said second end.

5. The garment of claim 1, wherein said bottom end lies on or below said wearer's waist.

6. The garment of claim 5, further comprising at least one shoulder strap.

7. The garment of claim 6, the body portion further comprising a first end and a second end, wherein a fastener releasably attaches said first end and said second end.

8. The garment of claim 5, the body portion further comprising a first end and a second end, wherein a fastener releasably attaches said first end and said second end.

9. The garment of claim 1, wherein said bottom end lies above said wearer's waist.

10. The garment of claim 9, further comprising at least one shoulder strap.

11. The garment of claim 10, the body portion further comprising a first end and a second end, wherein a fastener releasably attaches said first end and said second end.

12. The garment of claim 9, the body portion further comprising a first end and a second end, wherein a fastener releasably attaches said first end and said second end.

13. A garment to be worn by a wearer, comprising:
- a body portion, the body portion having a top end, a bottom end, an anterior fabric portion, a posterior fabric portion, and a cup portion, wherein
  - each of the anterior fabric portion and the posterior fabric portion has an inner face and an outer face, and
  - a single piece of fabric comprises the anterior fabric portion and the posterior fabric portion;
- a binding attached to at least one of the top end or the bottom end of the body portion;
- a plurality of tubular channels attached to the inner face of one of the anterior fabric portion and the posterior fabric portion; and
- a plurality of bonings, wherein at least one boning is fitted into each of the plurality of channels.

14. The garment of claim 13, further comprising at least one shoulder strap.

15. The garment of claim 14, the body portion further comprising a first end and a second end, wherein a fastener releasably attaches said first end and said second end.

16. The garment of claim 13, the body portion further comprising a first end and a second end, wherein a fastener releasably attaches said first end and said second end.

17. The garment of claim 13, wherein said bottom end lies on or below said wearer's waist.

18. The garment of claim 17, further comprising at least one shoulder strap.

19. The garment of claim 18, the body portion further comprising a first end and a second end, wherein a fastener releasably attaches said first end and said second end.

20. The garment of claim 17, the body portion further comprising a first end and a second end, wherein a fastener releasably attaches said first end and said second end.

21. The garment of claim 13, wherein said bottom end lies above said wearer's waist.

22. The garment of claim 21, further comprising at least one shoulder strap.

23. The garment of claim 22, the body portion further comprising a first end and a second end, wherein a fastener releasably attaches said first end and said second end.

24. The garment of claim 21, the body portion further comprising a first end and a second end, wherein a fastener releasably attaches said first end and said second end.

* * * * *